United States Patent [19]

Zmoda et al.

[11] 4,436,525

[45] Mar. 13, 1984

[54] FUEL GEL FOR CHARCOAL OR WOOD FIRES

[75] Inventors: Barney J. Zmoda, Bridgewater; Paul J. Fessock, South Plainfield, both of N.J.

[73] Assignee: Colgate-Palmolive Company, New York, N.Y.

[21] Appl. No.: 475,818

[22] Filed: Mar. 16, 1983

[51] Int. Cl.[3] ..... C10L 7/04

[52] U.S. Cl. ..... 44/7.3; 44/38

[58] Field of Search ..... 44/7 A, 7 B, 7 C, 7 D, 44/7 R, 34, 35, 38

[56] References Cited

U.S. PATENT DOCUMENTS

| | | | |
|---|---|---|---|
| 2,492,173 | 12/1949 | Mysels | 44/7 A |
| 2,553,568 | 5/1951 | Finkelstein | 44/7 A |
| 3,759,674 | 9/1973 | Gregg | 44/7 C |
| 4,084,939 | 4/1978 | Zmoda | 44/7 C |
| 4,261,700 | 4/1981 | Monick | 44/7 C |

*Primary Examiner*—Leland A. Sebastian
*Assistant Examiner*—Joel P. Okamoto
*Attorney, Agent, or Firm*—Herbert S. Sylvester; Murray M. Grill; John A. Stemwedel

[57] ABSTRACT

A solid alcohol fuel for starting charcoal or wood fires which burns without melting or flowing, comprising an anhydrous gel consisting essentially of a major proportion of an alcohol mixture of methanol and isopropanol in the weight ratio of about 3:1, and a fatty acid soap gelling agent. The alcohol content preferably constitutes at least about 85% by weight of the total composition. The fatty acid soap gelling agent is made in situ by reacting anhydrous sodium hydroxide dissolved in anhydrous methanol with a fatty acid dissolved in an anhydrous mixture of methanol and isopropanol.

7 Claims, No Drawings

FUEL GEL FOR CHARCOAL OR WOOD FIRES

BACKGROUND AND PRIOR ART

The present invention relates to an anhydrous alcohol fuel gel composition which doesnot liquify during burning, but maintains its free-standing original shape such as a cube and the like. This anhydrous fuel gel does not flow during the burning period but remains in place, does not spread and will not penetrate the charcoal or wood being ignited, which is critical to fire starters.

Liquid fuels, or solids that liquify while burning, may flow through seams or openings in the floor of a brazier, creating a fire hazard. In a fireplace, such liquifaction could saturate the floor surface, and in a wood-burning stove, be a possible fire hazard, also.

A wide variety of products are currently sold for use as charcoal and wood fire starters. However, many of these products are subject to one or more disadvantages. For example, liquid type fuels tend to burn very rapidly and require another application for ignition. This shortcoming of liquid fuels is due to their liquid form which does not normally adhere in sufficient amounts to the briquettes but instead flows off the sides thereof. Additionally, liquid fuels can be dangerous because of the problem of flame flashback wherein the dispensing stream of liquid becomes ignited causing the liquid in the dispensing container to ignite.

Another commercial fire starter product is an impregnated solid which requires a physical breaking and distribution thereof. Such steps are time consuming, and often result in the soiling of the hands or clothes of the user, thereby causing consumer dissatisfaction.

Gel hydrocarbon based fire starter products as shown in U.S. Pat. Nos. 718,318 and 1,868,568, have also been used, but these are characterized by burning with an odor and producing a relatively large amount of soot. Additionally, these gel products tend to melt upon burning and do not maintain their shape but instead tend to flow over the charcoal briquettes forming a thin film of gelled material analagous to the liquid fuels. This characteristic shortens the product burning time and relatively large amounts of the gel must be used to effect ignition of the charcoal.

Alcohol fuel gel products are known for commercial applications and such products burn with a clean, non-sooty flame. Such products are available in containers wherein the burning occurs, as shown in U.S. Pat. Nos. 1,266,080; 1,277,149; 1,389,638; and 1,484,190. The containment of the alcohol gel eliminates the necessity of producing a non-liquifying immobile gel which retains its original shape during burning. The alcohol fuel gel may also be in the form of a paste gel which is dispensed from a squeeze tube as shown in U.S. Pat. No. 3,183,068; or in the form of individual cubes as disclosed in U.S. Pat. No. 1,545,595. All of aforesaid alcohol fuel gels comprise a lower aliphatic alcohol such as ethyl and methyl alcohol per se or in admixture and the sodium stearate gelling agent made in situ in the presence of water, either by reacting aqueous sodium hydroxide with stearic acid dissolved in alcohol, or by reacting caustic soda dissolved in non-anhydrous alcohol (i.e. 190 proof denatured alcohol). U.S. Pat. No. 1,545,595 utilizes a considerable amount of a non-solvent for the fatty acid soap reaction product, such as methyl acetone, in order to prevent liquifaction of the alcohol gel while burning. Water is present to help solution of the soap (sodium stearate), the presence of a minimal amount (5–25%) of water being necessary to develop a good gel structure as alleged in U.S. Pat. No. 3,183,008.

Alcoholic fuel gels have also been made with non-soap gelling agents including natural and synthetic gums such as cellulose and modified celluloses, i.e. methyl or ethyl cellulose, hydroxyethyl-, hydroxymethyl-cellulose, nitrocellulose and the like; and hydrophilic carboxy vinyl polymers. U.S. Pat. No. 3,183,068 discloses that water must be present in the alcohol gel composition consisting of a mixture of ethanol and methanol in the weight ratio of 7:1, in order to develop a good gel structure which does not lose its shape as extruded, or run off during combustion. U.S. Pat. No. 3,148,958 also discloses an extrudable stable gel which does not break down during combustion, comprising a mixture of ethanol and isopropyl alcohol (2.5:1 weight ratio) or ethanol per se, a carboxyvinyl copolymer gelling agent and about 5–10% water. The alcohol fuel gel in U.S. Pat. No. 3,214,252 comprises an olefinmaleic anhydride copolymer gelling agent, methyl-, ethyl- or propyl-alcohol, up to 40% water and alkaline neutralizing compound to adjust the pH of the composition to about 6–9, which is extrudable and retains its shape during the period of combustion. Above a pH of 9, said gel is fluid, could not be extruded from the tube and did not hold its shape although capable of burning. U.S. Pat. No. 3,271,120 discloses a stable audibly burning alochol gel comprising about 65–80% ethanol or a mixture of ethanol and methanol, nitrocellulose gelling agent and 15–30% water which gells the mixture. The thusly formed gel retains its shape throughout the combustion period. U.S. Pat. No. 4,084,939 discloses ethylene-acrylic acid copolymer dispersions as gelling agent, 40–90% of an alcohol containing 1–6 carbon atoms or mixtures thereof (ethanol and isopropanol in weight ratio of 2:1) and encapsulated volatile solvent (xylene) which crackles as it burns. U.S. Pat. No. 4,261,700 discloses a shape-retaining mass of fuel gel composition containing 60–90% of an alcoholic mixture of a major amount of ethanol and a minor amount of $C_3$–$C_4$ alcohol, and a neutralized carboxy-vinyl polymer gelling agent, 3.5–11% water and 5–30% propellant in a pressurized container.

Thus, it is apparent that the above cited prior art alcohol fuel gels, regardless of the particular gelling agent utilized or the particular lower aliphatic alcohol or combination of alcohols used, require the presence of some water to provide a desired gel structure. In addition, the soap gelling agent needs water to act as a solution aid for said soap.

U.S. Pat. No. 3,754,877 discloses a gelled fuel composition which does not require water to promote gelation, comprising an aliphatic alcohol having 1–5 carbon atoms and 0.2–2% of a cross-linked olefin-modified hydroxyalkyl cellulose. The resultant gels are stiff, rubbery and non-flowable gels, which burn smoothly with a colorless soot-free flame, leaving little residue after burning. These gels have particular utility as fuels for chafing dishes and warming trays. No mention is made of its use as a fire starter.

U.S. Pat. No. 4,238,201 discloses a grill charcoal lighter comprising a pasty emulsion in a cellophane foil, comprising 65–94% alcohol such as isopropanol, 4–13% of a triethanolamine salt of alkylbenzene sulfonic acid in an aqueous solution as emulsifier, and 2–22% of fine particles of silicon tetrachloride as filler.

However, none of the above cited art discloses a solid alcohol fuel for starting charcoal or wood fires comprising an anhydrous gel which does not liquify during combustion, comprising a major proportion of an anhydrous alcoholic mixture of methanol and isopropanol in the weight ratio of about 3:1, and a fatty acid soap gelling agent prepared in situ.

SUMMARY OF THE INVENTION

It has been unexpectedly found that dissolving the caustic in the methanol precludes the need of water to solubilize the in situ reaction with the fatty acid to effect gelation of the alcohol. It has additionally been found that keeping the gel anhydrous unexpectedly results in a gel which does not liquify when burned, provided a mixture of methanol and isopropanol in critical proportions of about 3:1 by weight is utilized as the alcohol component.

Accordingly, a primary object of present invention is to provide a solid alcohol fuel as a fire starter which retains its original shape and will not melt and flow during its burn.

Another object of present invention is to provide a solid alcohol fuel composition which burns with a smokeless, odorless and visible flame.

Still another object of present invention is to provide a solid alcohol fuel gel which produces a flame of sufficient duration (burn time) to ignite a combustible material such as wood or charcoal.

Still another object of present invention is to provide a solid alcohol fuel which produces a flame of sufficient heat (burning temperature) to ignite the combustible material.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, the novel solid alcohol fuel of this invention comprises an anhydrous gel that will burn without melting or flowing consisting essentially of a major proportion of an anhydrous alcohol mixture of methanol and isopropanol in the weight ratio of about 3:1, and a fatty acid soap gelling agent prepared in situ.

More specifically, present invention relates to a solid alcohol fuel for starting charcoal or wood fires, which is in the form of a free-standing soft firm, molded solid composition comprising at least about 85% by weight of an anhydrous alcohol mixture of methanol and isopropanol, with the isopropanol constituting at least 20% by weight of the total composition and the ratio of methanol to isopropanol is about 3:1, and a minor amount of a fatty acid soap gelling agent prepared in situ by reacting anhydrous sodium hydroxide dissolved in anhydrous methanol with a fatty acid dissolved in an anhydrous mixture of methanol and isopropanol.

The preparation of the solid fuel fire starter of present invention is a three step process which comprises dissolving the anhydrous alkali such as sodium hydroxide in a portion of the anhydrous methanol and warming the solution to 100°-120° F.; heating the mixture of the remaining methanol and isopropanol to about 140°-160° F. (160° F. is the boiling point of the mixture) and adding the fatty acid, such as stearic acid, which will melt immediately; admixing the sodium hydroxide/methanol solution with the fatty acid/alcohol solution and pouring the mixture into molds. This product solidifies rapidly into a soft firm free-standing solid gel in the shape of the mold, such as cubes or the like.

DETAILED DESCRIPTION OF THE INVENTION

The major component of present fire starter composition is the specific alcohol mixture of methanol and isopropanol in specific proportions which provides the flame upon ignition. This combination of specific alcohols as well as the proportions of each alcohol is critical in the production of a fuel which does not melt during the buring period, and provides a flame of sufficient burn-time to ignite the combustible material such as charcoal or wood. These critical features are clearly shown in Table I, wherein comparative results of compositions containing methanol per se and methanol with incremental increases of isopropanol are cited.

EXAMPLES 1-5

| Ingredients | Ex. 1 % | Ex. 2 % | Ex. 3 % | Ex. 4 % | Ex. 5 % |
|---|---|---|---|---|---|
| MeOH[1] | 86.5 | 81.5 | 76.5 | 71.5 | 66.5 |
| Stearic acid | 5.5 | 5.5 | 5.5 | 5.5 | 5.5 |
| 10% NaOH/ MeOH | 8.0 | 8.0 | 8.0 | 8.0 | 8.0 |
| PHTH[3] | — | 2 Drops | 2 Drops | 2 Drops | 2 Drops |
| IPA[2] | — | 5 | 10 | 15 | 20 |

[1]methanol
[2]isopropanol
[3]phenolphthalein, an acid-base indicator which is pink on the alkaline side; therefore, it turns the mixture pink when sufficient caustic has been added to neutralize the stearic acid.

PHTH was used solely as an indicator of expediency to show when sufficient caustic had been added. Once the proper amount was established, it was not absolutely needed.

These compositions are prepared by the three step process aforesdescribed. The gelling agent, sodium stearate, is formed in situ and is soluble in the alcoholic medium.

TABLE I

| Examples | Sluice Burn* | Rate of Melt Gm | Rate of Melt % Residue | Burn Time |
|---|---|---|---|---|
| 1 | melted fast | 0.3 | 6 | 2'45" |
| 2 | melted fast | 0.2 | 4 | 2'40" |
| 3 | melted fast | 0.2 | 4 | 2'40" |
| 4 | melted medium | | — | — |
| 5 | no melt | 0.2 | 4 | 4'40" |

*The 5 gram block is placed at the top of an inclined run, "a sluice", and ignited. The formulation is then rated in its ability to keep from melting due to the heat, and running down the incline.

A slice of solid gel is burned in the open, not in a container, to give the Rate of Melt results. The Burn Time is regulated by the formation of a "skin" around a free-standing cube. Five gram samples were used.

These results clearly show the criticality of utilizing a mixture of methanol and isopropanol, wherein the isopropanol constitutes at least 20% by weight of the total composition, and the ratio of methanol to isopropanol is about 3:1 in order to obtain a non-melting gel. Methanol per se and methanol combined with less than 20% by weight of isopropanol produces a gel which melts during its burn. This Table also shows the increase in burn time obtained with the composition of present invention (Example 5) which is an essential feature of a safe and effective fire starter composition. Since effective fire starters are designed to provide a flame duration (burn time) of at least about four minutes, examples 1–4 lack an essential element of a suitable fire starter.

The gelling agents utilized in present alcohol fuel gel compositions are water-soluble fatty acid soaps, preferably sodium stearate, formed in situ by the complete reaction of equimolecular amounts of a higher fatty acid and an alkali such as sodium hydroxide, past neutralization to about pH 9. No free fatty acid is present in this reaction product, as is commonly found in prior art reaction products. It is the free fatty acid, i.e. stearic acid, which crystallizes and causes liquifaction of the alcohol gel. It has been found in experimentation, that if the fatty acid is not sufficiently neutralized, it will, in time, make itself evident by crystallizing within the gel. The resultant gel loses its translucency. These gels did not start as a pink mixture (from the PHTH indicator) indicating insufficient caustic. Such gels always had a fast melting characteristic. The rapid melting of the gel was imparted by the low melting point of the fatty acid. The fatty acid soap gelling agent free of fatty acids, such as sodium stearate, forms a crust which is permeable to the alcohol flame, thereby avoiding liquifaction of the gel. Sodium stearate is the preferred gelling agent, because it results in a hard gel. Fatty acid soaps such as the sodium or potassium salts of coco, oleic, and isostearic acids yield a soft gel. Also, the use of potassium stearate results in a soft gel. Minor amounts of the soap gelling agent are utilized to produce a film alcohol gel, preferably about 1–6.5% and most preferably about 5.5–6.5% by weight of the composition.

It has been found that non-melting gels are productive of better heat, i.e. higher flame temperatures of longer duration, another essential property of a fire starter, as shown in Table II, wherein melting products Examples 6 and 7, and non-melting products Example 8, are compared. Examples 6 and 7 contain free fatty acid as a result of the low NaOH content.

EXAMPLES 6–8

| Ingredients | Ex. 6 Gms. | Ex. 7 Gms. | Ex. 8 Gms. |
|---|---|---|---|
| MeOH | 65 | 65 | 65 |
| IPA | 26 | 26 | 26 |
| Stearic | 5.5 | 5.5 | 5.5 |
| NaOH/25[3] | 2.0 | 2.5 | 3.26 |
| PHTH | 2 Drops melts during burn | 2 Drops melts | 2 Drops does not melt |

[3]25% aqueous caustic soda (sodium hydroxide)

30 gm samples of the freshly made products are placed in aluminum cups for testing.

TABLE II

| Ex. | Mins. into Burn | Height In Inches Above Cup Surface 0" | ½" | 1" | 2" | 3" | Flame Out Time |
|---|---|---|---|---|---|---|---|
| 6 | +2 | 702° F. | 980° F. | 1280° F. | 1300° F. | 1100° F. | |
| | +6 | 810° F. | 1080° F. | 1280° F. | 1300° F. | 1100° F. | 11'30" |
| 7 | +2 | 817° F. | 1130° F. | 1210° F. | 1315° F. | 1200° F. | |
| | +6 | 860° F. | 1160° F. | 1050° F. | — | — | 9'50" |
| 8 | +2 | 850° F. | 1110° F. | 1409° F. | 1420° F. | 1300° F. | |
| | +6 | 980° F. | 1150° F. | 1250° F. | 1330° F. | 1130° F. | 11'25" |

It is essential that the alcohol/soap gel of present invention be anhydrous in order to prevent liquifaction of the gel composition during its burn. This is achieved by dissolving the caustic in methanol, which precludes the need of water to solubilize the in situ reaction product. Heretofore, gel formation depended on the presence of a sufficient amount of water to provide the desired gel structure. However, the presence of water often affects the burning rate of the alcohol and thus must be integrated with the proportions of alcohol. Furthermore, water was needed to solubilize the in situ reaction of fatty acid with the alkali. Since sodium hydroxide readily dissolves in methanol to form a 10% solution, the need for an aqueous sodium hydroxide solution has been eliminated. This has enabled the preparation of a firm anhydrous alcohol/soap gel which maintains its original shape during the entire burning period. The gel will not flow, but remains in place, does not spread and will not penetrate, which is critical to fire starters. The non-melting and non-flowing characteristics of present solid fuel compositions provides a particularly desirable fire starter for wood or charcoal because it will not spill out of, or through, the fireplace or grill.

The present solid alcohol fuel compositions burn with a smokeless, odorless flame for the duration of the burn time and until all the alcohol is removed. The flame is also visible due to the presence of sodium in the composition. The solid fuel gel, in the form of free-standing cubes or the like, may preferably be sealed to prevent evaporation of the alcohol until used.

The novel anhydrous alcohol gel compositions of present invention can also have optional ingredients incorporated therein which do not adversely affect its properties. Such ingredients include small amounts of dyes, such as, phenolphthalein, or Rose Bengal dye, for identification or aesthetic value. Usually the dyes are introduced in alcoholic solution. Other optional ingredients include perfumes, ash reducing agents such as sodium and potassium salts of nitrates and chlorates, and flame coloring agents including compounds of lithium, boron, copper and, others commonly known to produce vivid flame colors. These optional ingredients are present in small amounts which usually do not exceed 1% by weight and preferably are less than 0.5% by weight.

The following examples and the preceeding examples are illustrative of the inventive compositions and products which, it is understood, are not limited to the examples. In the examples, all percentages are on a weight basis unless otherwise indicated.

| Ingredients | % |
|---|---|
| Methanol | 67.7 |
| Isopropanol | 26.0 |
| Stearic Acid | 5.5 |
| Sodium Hydroxide | 0.8 |

All the ingredients are anhydrous.

10 gms NaOH pellets are dissolved in 90 gms methanol to make a 10% NaOH/methanol solution and warmed to 100° F.

The stearic acid is added to the mixture of isopropanol and the remaining methanol, and heated to a temperature of at least 140° F., wherein it melts immediately.

The warm alcohol solution of sodium hydroxide is added with agitation to the warm fatty acid/alcohol mixture and poured into molds, wherein it solidifies rapidly.

The sodium stearate reaction product is soluble in the alcohol medium.

The resultant fuel gel burns without melting and maintains its original shape during the entire burning period which is 5 minutes and 52 seconds, leaving a 6% residue (0.3 gm of a 5 gm sample). It is noted that the sodium stearate gelling agent constitutes 6.3% of the total composition which probably accounts for the 6% residue.

The 5 gm sample used for burning time/melting experiments is not a recommended weight for practical application. After having panel-tested a 1.5 ounce tablet, it was found that a 1.5 ounce fuel gel is the minimum weight required to both, start and continue the burning of fairly thick pieces of wood.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. A solid alcohol fuel fire starter comprising a firm, free-standing molded solid anhydrous alcohol gel which does not liquify during combustion consisting essentially of a major proportion of an anhydrous alcoholic mixture of methanol and isopropanol in the weight ratio of about 3:1, and a fatty acid soap gelling agent.

2. The solid alcohol fuel of claim 1, wherein the alcohol constitutes at least 85% by weight of an anhydrous mixture of methanol and isopropanol with the isopropanol constituting at least 20% by weight of the total composition.

3. The solid alcohol fuel of claim 1, wherein the fatty acid soap gelling agent is prepared in situ by reacting anhydrous alkali dissolved in anhydrous methanol with a fatty acid dissolved in an anhydrous mixture of methanol and isopropanol.

4. The solid fuel of claim 3, wherein the alkali is sodium hydroxide and the fatty acid is stearic acid.

5. The solid fuel of claim 3, wherein equimolecular amounts of alkali and fatty acid are reacted past neutralization to about pH 9.

6. The solid fuel of claim 1, wherein the fatty acid soap gelling agent forms a crust which is permeable to the alcohol flame during its burning period.

7. A method of preparing the solid fuel of claim 1, which comprises the steps of:

dissolving the anhydrous alkali in a portion of the anhydrous methanol and warming the solution to about 100°-120° F.;

heating the mixture of the remaining methanol and isopropanol to about 140°-160° F. and adding the fatty acid which melts immediately;

admixing the alkali/methanol solution with the fatty acid/alcohol solution and pouring the mixture into molds.

* * * * *